US010072838B2

(12) United States Patent
Kim

(10) Patent No.: US 10,072,838 B2
(45) Date of Patent: Sep. 11, 2018

(54) NOZZLE STRUCTURE OF BURNER

(71) Applicant: KOVEA CO., LTD., Bucheon-si (KR)

(72) Inventor: Sang Hyun Kim, Goyang-si (KR)

(73) Assignee: KOVEA CO., LTD., Gyeonggi-Do (KR)

( * ) Notice: Subject to any disclaimer, the term of this patent is extended or adjusted under 35 U.S.C. 154(b) by 414 days.

(21) Appl. No.: 14/584,163

(22) Filed: Dec. 29, 2014

(65) Prior Publication Data

US 2015/0192301 A1 Jul. 9, 2015

(30) Foreign Application Priority Data

Jan. 7, 2014 (KR) ..... 10-2014-0001642

(51) Int. Cl.

| | |
|---|---|
| ***F24C 3/12*** | (2006.01) |
| ***F23D 11/38*** | (2006.01) |
| ***F23D 11/44*** | (2006.01) |
| ***F23D 11/46*** | (2006.01) |

(52) U.S. Cl.

CPC ..... *F23D 11/386* (2013.01); *F23D 11/443* (2013.01); *F23D 11/46* (2013.01); *F23D 2209/00* (2013.01); *F23D 2900/00002* (2013.01)

(58) Field of Classification Search

USPC ..... 126/38, 39 N

See application file for complete search history.

(56) References Cited

U.S. PATENT DOCUMENTS 1,047,028 A * 12/1912 Foster et al. ..... F24C 3/14 126/40
1,947,194 A * 2/1934 Engh ..... F23C 99/00 431/120
1,978,772 A * 10/1934 Tiberg ..... F23D 11/44 239/117
2,153,379 A * 4/1939 Lucas ..... F24C 5/18 126/110 E (Continued)

FOREIGN PATENT DOCUMENTS

CN 102937529 2/2013
JP 40010278 4/1965

(Continued)

*Primary Examiner* — Avinash Savani
*Assistant Examiner* — Martha Becton
(74) *Attorney, Agent, or Firm* — Cantor Colburn LLP

(57) ABSTRACT

A nozzle structure of a burner includes: a housing having an exhaust opening penetratingly-formed at an upper surface thereof, and having therein an accommodation space communicated with the exhaust opening; a fuel supply member connected to the housing such that one end thereof communicates with one side of the accommodation space, for supply of liquid fuel to inside of the accommodation space; a fuel supply controller accommodated in the accommodation space so as to be movable up and down, and having a fuel supply micro-control member at an end thereof, the fuel supply micro-control member configured to micro-control the amount of fuel to be supplied, by being selectively inserted into or separated from the exhaust opening as it moves up and down; and a heating pipe connected to two sides of an outer surface of the housing with different heights, so as to communicate with the accommodation space.

5 Claims, 3 Drawing Sheets

(56) References Cited

U.S. PATENT DOCUMENTS 2,397,766 A * 4/1946 Tullis ..... F23D 11/44 126/304 R
2,455,950 A * 12/1948 Robinson ..... F23D 91/02 431/123
2,463,830 A * 3/1949 Tullis ..... F23D 11/44 138/113
2,478,364 A * 8/1949 Bramming ..... F23D 11/44 126/38
2,538,538 A * 1/1951 Stempel ..... F24C 5/20 126/38
3,877,458 A * 4/1975 Allander ..... F24C 3/14 126/38
4,078,540 A * 3/1978 Hou ..... F23D 11/42 124/44
5,803,727 A * 9/1998 Long ..... F23D 11/443 126/38
D416,750 S * 11/1999 Persson ..... D7/337
6,042,368 A * 3/2000 Champion ..... F23D 14/28 137/505.39
D424,364 S * 5/2000 Persson ..... D7/337
6,182,651 B1 * 2/2001 Tornsten ..... F23D 11/443 126/38
6,213,760 B1 * 4/2001 Yokoyama ..... F24C 3/14 431/247
6,688,877 B1 * 2/2004 Draper ..... F21L 19/00 431/104
9,429,327 B2 * 8/2016 Kim ..... F23D 14/28
2014/0290639 A1 * 10/2014 Kim ..... F23D 14/28 126/38

FOREIGN PATENT DOCUMENTS

| | | |
|---|---|---|
| JP | 61161513 | 10/1986 |
| JP | 2004044854 | 2/2004 |
| JP | 3957282 | 5/2007 |
| JP | 3957282 | 8/2007 |
| TW | M417507 | 12/2011 |

* cited by examiner

NOZZLE STRUCTURE OF BURNER

BACKGROUND OF THE INVENTION

1. Field of the Invention

This specification relates to a nozzle structure of a burner, and more particularly, to a nozzle structure of a burner capable of temporarily blocking supply of liquid fuel.

2. Background of the Invention

In the conventional liquid fuel burner used outdoors for cooking, etc., a heat source necessary to cook food is obtained as supplied liquid fuel is combusted through vaporization. However, the conventional liquid fuel burner may have the following problems. Firstly, an exhaustion opening, through which fuel is supplied, is blocked due to foreign materials included in the liquid fuel. Further, as foreign materials are attached to the exhaustion opening, ignition is not smoothly performed and fuel is not stably combusted.

Besides, when fuel supply is not stably performed, flame ignition is not stable. That is, a large amount of flame ignites instantaneously, and then shrinks, repeatedly. This may cause a user's fear. However, the conventional liquid fuel burner is not provided with an additional device for micro-controlling the amount of fuel to be supplied. This may cause a user's inconvenience.

Recently, demands for a burner which can be used conveniently and stably by solving such problems, are highly required.

SUMMARY OF THE INVENTION

Therefore, an aspect of the detailed description is to provide a nozzle structure of a burner, capable of stably combusting a burner by micro-controlling the amount of fuel supplied to the burner, and capable of preventing inferior ignition by effectively removing foreign materials attached to an end of a nozzle.

The present invention having such a purpose may not be limited to a liquid fuel burner, but may be applied to various camping equipment such as a gas burner, a lantern and a device for exterminating harmful insects.

Purposes of the present invention may not be limited to the aforementioned purpose, and other purposes not mentioned may be specifically understood from the following descriptions by those skilled in the art.

To achieve these and other advantages and in accordance with the purpose of this specification, as embodied and broadly described herein, there is provided a nozzle structure of a burner, including: a housing having an exhaust opening penetratingly-formed at an upper surface thereof, and having therein an accommodation space communicated with the exhaust opening; a fuel supply member connected to the housing such that one end thereof communicates with one side of the accommodation space, for supply of liquid fuel to inside of the accommodation space; a fuel supply controller accommodated in the accommodation space so as to be movable up and down, and having a fuel supply micro-control member at an end thereof, the fuel supply micro-control member configured to micro-control the amount of fuel to be supplied, by being selectively inserted into or separated from the exhaust opening as it moves up and down; and a heating pipe connected to two sides of an outer surface of the housing with different heights, so as to communicate with the accommodation space, such that liquid fuel supplied through the accommodation space is vaporized to be supplied to the exhaust opening.

The accommodation space may include a supply portion disposed at an upper side than a connection point of the fuel supply member, communicated with the exhaust opening, and configured to supply fuel; a communication portion provided at a connection point of one end of the heating pipe, and configured to supply liquid fuel toward the heating pipe; and an accommodation portion disposed at a lower side than the connection point of the fuel supply member, having a diameter larger than that of the communication portion, and configured to accommodate therein part of the fuel supply controller.

The fuel supply controller may include a shielding member having the same diameter as the accommodation portion, disposed in the accommodation portion, and configured to block a communication hole as it moves up and down; and an extension member extending from an upper surface of the shielding member with a predetermined length, having a smaller diameter than the shielding member, and disposed in the communication portion.

A boundary region between the communication portion and the accommodation portion, and a boundary region between the communication portion and the supply portion may have a tapered shape, respectively.

A handle may downward extend from a lower surface of the shielding member with a predetermined length, so as to protrude toward outside of the housing.

A plurality of sealing members of a ring shape may be provided on an outer surface of the shielding member with a predetermined distance therebetween, in a height direction of the shielding member.

A stopper, which protrudes with a predetermined diameter, may be provided at a lower circumferential surface of the shielding member. A lower cap having a stepped surface may be coupled to a lower surface of the housing, the stepped surface configured to restrict movement of the shielding member by contacting one end of the stopper.

The present invention can have the following advantages.

Firstly, since the amount of fuel supplied to a burner is micro-controlled, combustion can be stably performed.

Secondly, since foreign materials attached to an end of a nozzle are effectively removed, inferior ignition can be prevented.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of preferred configurations of mobile terminals according to the present invention, with reference to the accompanying drawings.

Figure 1:
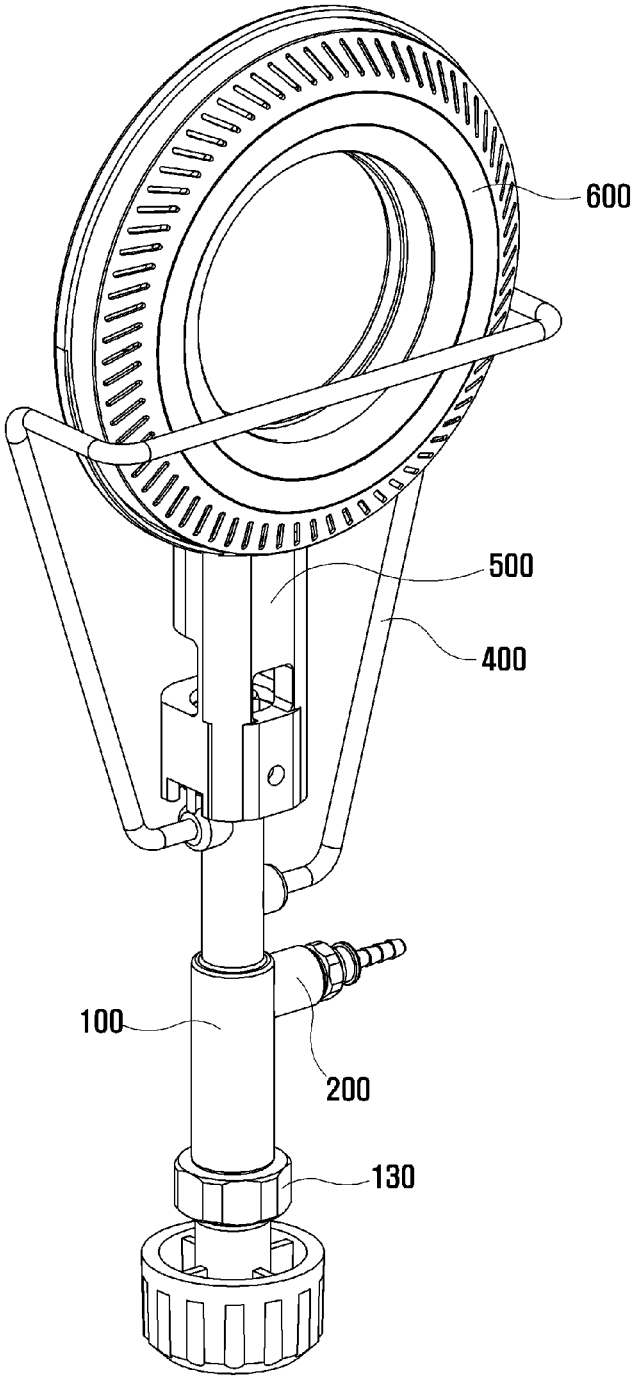
FIG. 1 is a perspective view illustrating a nozzle structure of a burner according to an embodiment of the present invention.
Figure 2:
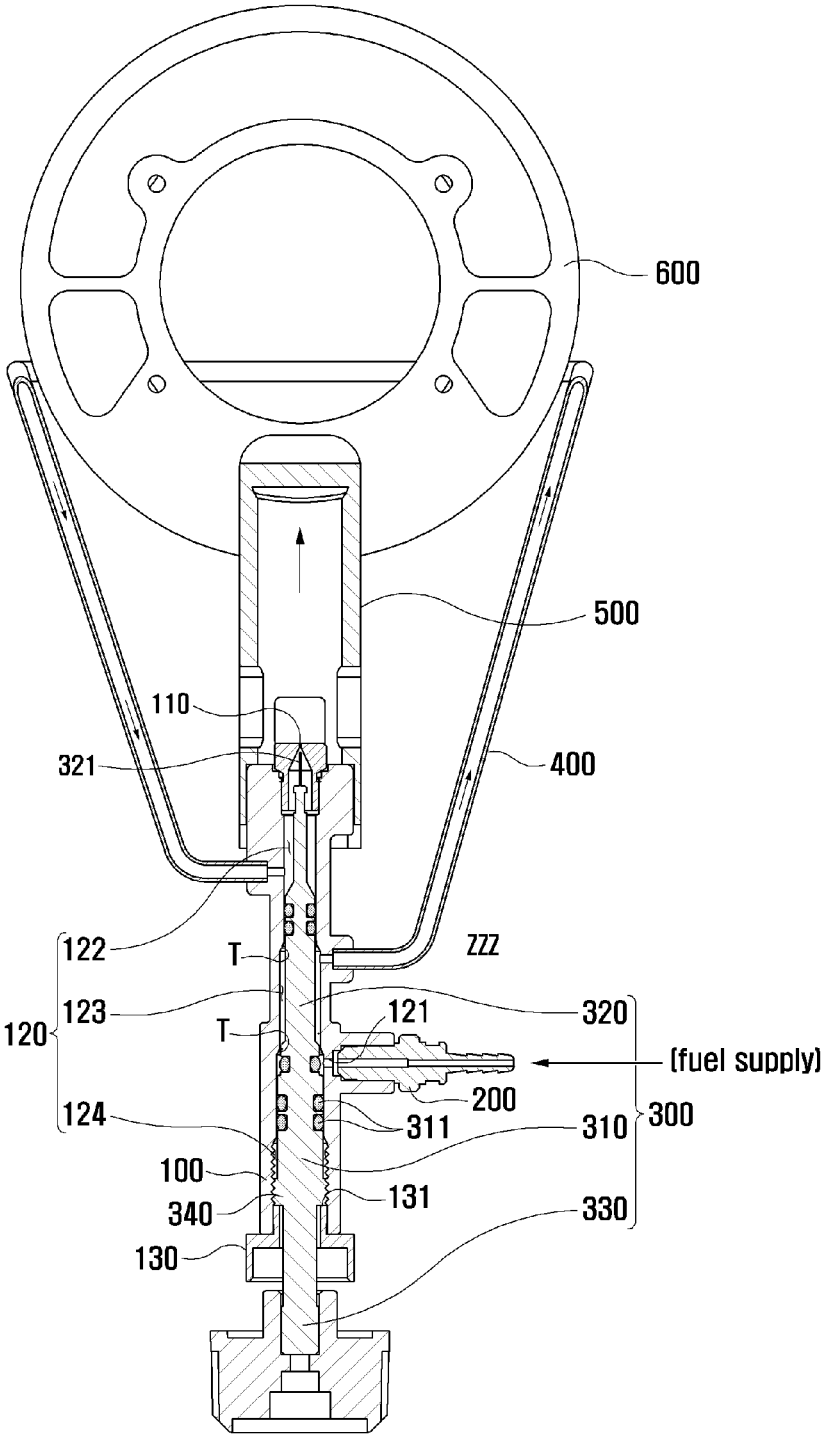
FIG. 2 is a longitudinal sectional view illustrating an inner structure of FIG. 1 when fuel is supplied.
Figure 3:
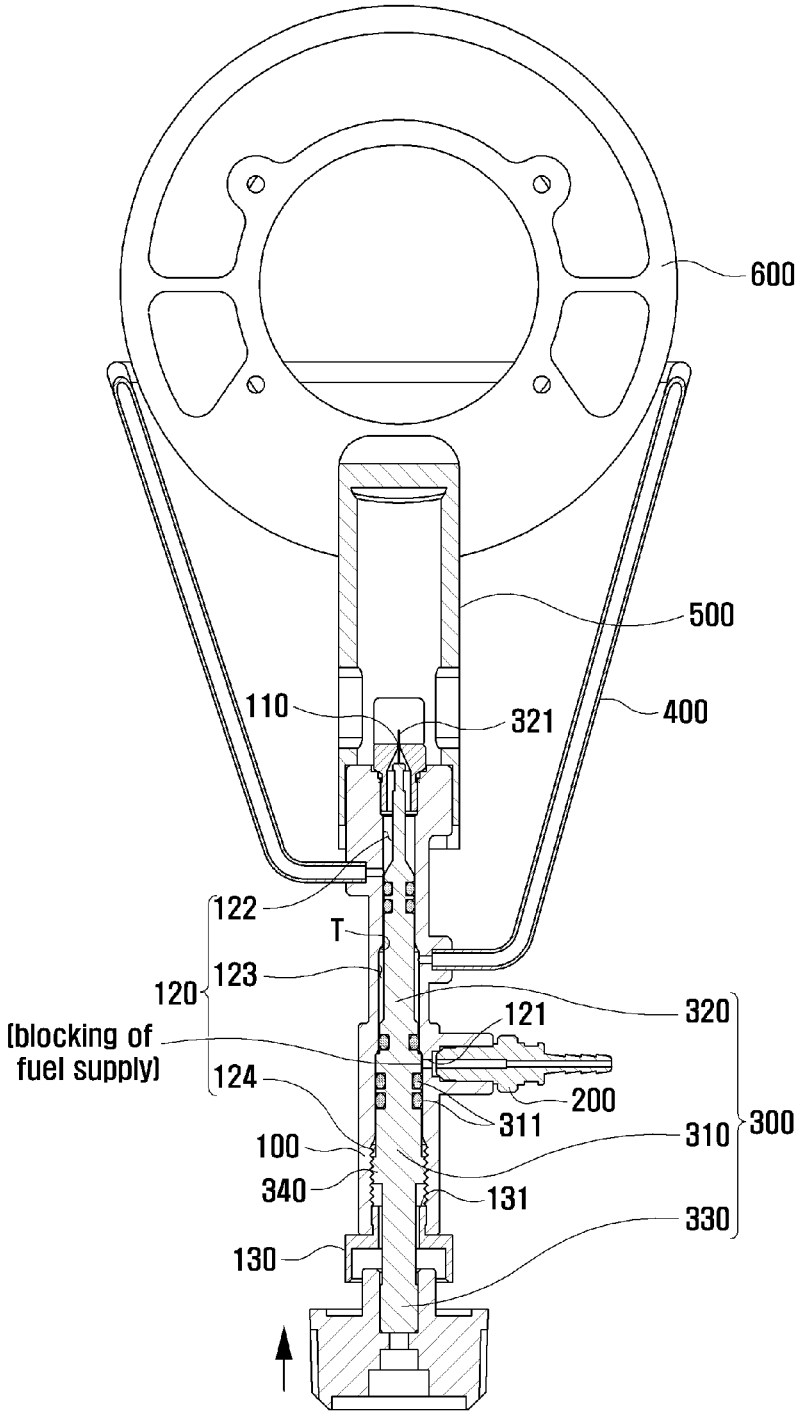
FIG. 3 is a longitudinal sectional view illustrating an inner structure of FIG. 1 when fuel is not supplied.

FIG. 1 is a perspective view illustrating a nozzle structure of a burner according to an embodiment of the present invention. FIG. 2 is a longitudinal sectional view illustrating an inner structure of FIG. 1 when fuel is supplied. FIG. 3 is a longitudinal sectional view illustrating an inner structure of FIG. 1 when fuel is not supplied.

As shown, a nozzle structure of a burner according to an embodiment of the present invention includes a housing 100 having an exhaust opening 110 penetratingly-formed at an upper surface thereof, and having therein an accommodation space 120 communicated with the exhaust opening 110; a fuel supply member 200 connected to the housing 100 such that one end thereof communicates with one side of the accommodation space 120, for supply of liquid fuel to inside of the accommodation space 120; a fuel supply controller 300 accommodated in the accommodation space 120 so as to be movable up and down, and having a fuel supply micro-control member 321 at an end thereof, the fuel supply micro-control member 321 configured to micro-control the amount of fuel to be supplied, by being selectively inserted into or separated from the exhaust opening 110 as it moves up and down; and a heating pipe 400 connected to two sides of an outer surface of the housing 100 with different heights, so as to communicate with the accommodation space 120, such that liquid fuel supplied through the accommodation space 120 is vaporized to be supplied to the exhaust opening 110.

The housing 100 is a cylindrical member having therein the accommodation space 120. The exhaust opening 110, through which fuel supplied to the accommodation space 120 is supplied to a combustion portion 600 through a communication member 500, is penetratingly-formed at an upper surface of the housing 100.

A lower part of the exhaust opening 110 may be tapered such that a diameter of the exhaust opening 110 is gradually decreased toward an upper side.

The reason why the lower part of the exhaust opening 110 is tapered, is in order to stably combust the burner, by controlling the amount of supply of vaporized fuel, according to an inserted depth of the fuel supply micro-control member 321 into the lower part of the exhaust opening 110.

The reason why the lower part of the exhaust opening 110 is tapered, is in order for the fuel supply micro-control member 321 to be inserted into the exhaust opening 110 with sliding along the tapered surface, in a case where the fuel supply controller 300 is moved up and down in a non-concentric state between the fuel supply micro-control member 321 and the exhaust opening 110.

The accommodation space 120 includes a supply portion 122 disposed at an upper side than a connection point of the fuel supply member 200, communicated with the exhaust opening 110, and configured to supply fuel; a communication portion 123 provided at a connection point of one end of the heating pipe 400, and configured to supply liquid fuel toward the heating pipe 400; an accommodation portion 124 disposed at a lower side than the connection point of the fuel supply member 200, having a diameter larger than that of the communication portion 123, and configured to accommodate therein part of the fuel supply controller 300.

One outer surface of the supply portion 122 is connected to one end of the heating pipe 400, such that vaporized fuel is supplied toward the exhaust opening 110. One outer surface of the communication portion 123 is connected to another end of the heating pipe 400, such that liquid fuel is supplied to inside of the accommodation space 120.

One outer surface and another outer surface of the supply portion 122, which are connected to one end and another end of the heating pipe 400, respectively, preferably have different heights so that vaporized fuel can be stably supplied toward the exhaust opening 110.

A lower cap 130 is coupled to a lower surface of the housing 100, and a flat stepped surface 131 is formed at an upper circumference of the lower cap 130. The stepped surface 131 restricts movement of the fuel supply controller 300, by contacting a lower surface of a stopper 340 of the fuel supply controller 300 to be explained later.

A screw thread is formed on a side surface of the stopper 340, and a screw thread engaged with the screw thread of the stopper 340 is formed on an inner surface of the housing 100, the inner surface contacting the stopper 340. With such a configuration, the fuel supply controller 300 can be moved by rotation.

The accommodation portion 124 having a relatively larger diameter, and the communication portion 123 having a smaller diameter than the accommodation portion 124 are provided with a tapered surface (T) at a circumferential surface of a boundary region therebetween. Further, the communication portion 123 having a relatively larger diameter, and the supply portion 122 having a smaller diameter than the communication portion 123 are provided with a tapered surface (T) at a circumferential surface of a boundary region therebetween. The tapered surface (T) is formed so that a diameter thereof can be decreased toward an upper side.

The fuel supply member 200 is connected to a just lower side of the tapered boundary region between the communication portion 123 and the accommodation portion 124, thereby supplying liquid fuel to inside of the accommodation space 120.

The reason why the fuel supply member 200 is not directly connected to the heating pipe 400, but the fuel supply member 200 is connected to a just lower side of the boundary region between the communication portion 123 and the accommodation portion 124 to supply liquid fuel, in order to supply fuel uniformly. More specifically, as liquid fuel is heated to a predetermined temperature while moving in a lengthwise direction of the housing 100 and then the liquid fuel is supplied toward the heating pipe 400, fuel can be uniformly supplied.

That is, in a case where liquid fuel supplied from the fuel supply member 200 is directly supplied to the heating pipe 400 to thus be drastically vaporized, flame ignition is not stably performed due to a pressure difference occurring in the heating pipe 400. In order to solve such problem, the fuel supply member 200 is connected to a just lower side of the boundary region between the communication portion 123 and the accommodation portion 124, such that flame ignition is stably performed as fuel is gradually vaporized in a lengthwise direction of the housing 100.

The fuel supply controller 300 blocks fuel supply to inside of the accommodation space 120, as an outer surface thereof selectively blocks the communication hole 121 penetratingly-formed at an outer surface of the housing 100 for connection with the fuel supply member 200.

The fuel supply controller 300 includes a shielding member 310 having the same diameter as the accommodation portion 124, disposed in the accommodation portion 124, and configured to block the communication hole 121 as it moves up and down; and an extension member 320 extending from an upper surface of the shielding member 310 with a predetermined length, having a smaller diameter than the shielding member 310, and disposed in the communication portion 123.

A stopper 340, configured to restrict a downward movement of the fuel supply controller 300 by contacting the stepped surface 131 of the lower cap 130, is protruding from a lower circumferential surface of the fuel supply controller 300.

A plurality of sealing members 311, configured to prevent liquid fuel supplied to inside of the accommodation space 120 from leaking to outside through a lower surface of the housing 100, are provided at an outer surface of the fuel supply controller 300 disposed at the accommodation portion 124.

For prevention of fuel leakage to outside, it is more effective to arrange the plurality of sealing members 311 with a predetermined distance therebetween in a height direction of the fuel supply controller 300.

The plurality of sealing members 311 are provided at a lower side and an upper side of the shielding member 310, respectively. The sealing members 311, provided at a lower side of the shielding member 310, serve to prevent liquid fuel from leaking to outside through a lower surface of the housing 100. On the other hand, the sealing members 311, provided at an upper side of the shielding member 310, serve to prevent liquid fuel from moving toward the exhaust opening 110 to thus prevent inferior ignition.

A handle 330 is downward extending from a lower surface of the shielding member 310 with a predetermined length, so as to protrude toward outside of the housing 100. As a user rotates the handle 330 clockwise or counterclockwise to control an inserted/withdrawn length of the fuel supply controller 300, fuel supply can be selectively blocked.

The fuel supply micro-control member 321, configured to remove foreign materials attached to the exhaust opening 110 by being selectively inserted into the exhaust opening 110, may protrude from an end of the extension member 320, the end facing the handle 330.

Preferably, an end portion of the fuel supply micro-control member 321 is sharply formed so as to protrude to outside of the exhaust opening 110, by penetrating foreign materials attached to the exhaust opening 110. Preferably, a diameter of the fuel supply micro-control member 321 is formed to be the same as a diameter of the exhaust opening 110, such that even foreign materials attached to an inner side surface of the exhaust opening 110 are removed to outside of the exhaust opening 110.

The heating pipe 400 is disposed to pass through an upper side of the exhaust opening 110, such that liquid fuel supplied from the fuel supply member 200 is vaporized. In order to supply vaporized fuel toward the exhaust opening 110 via the accommodation space 120, the heating pipe 400 is connected to two sides of an outer surface of the housing 100, so as to communicate with the accommodation space 120.

A communication member 500 is provided at an upper side of the housing 100 where the exhaust opening 110 is formed, and a combustion portion 600 of a ring shape is provided at an end of the communication member 500. With such a configuration, fuel exhausted through the exhaust opening 110 is introduced to the combustion portion 600 by the communication member 500, and then the fuel ignites at the combustion portion 600 by an additional ignition source.

The fuel, introduced to the combustion portion 600 by the communication member 500, is combusted during ignition, with being unfolded in a ring shape due to the ring-shaped combustion portion 600. Thus, the fuel can increase a contact area with an object to be heated, thereby rapidly heating the object to be heated.

Processes of micro-controlling the amount of fuel to be supplied to a liquid fuel burner, and of removing foreign materials attached to the exhaust opening, using the nozzle structure according to an embodiment of the present invention will be explained in more detail.

Once liquid fuel is introduced into the accommodation space 120 through the fuel supply member 200, the liquid fuel is upward moved in the accommodation space 120 by the sealing members 311 formed on an outer surface of the fuel supply controller 300. Then, the liquid fuel is introduced up to inside of the heating pipe 400.

The liquid fuel is heated to a predetermined temperature while moving in a lengthwise direction of the housing 100, and is introduced into the heating pipe 400 to thus be gradually vaporized in the heating pipe 400. As a result, a pressure difference due to drastic vaporization of liquid fuel does not occur in the heating pipe 400, and thus the liquid fuel can be stably supplied.

The supplied fuel is introduced to the combustion portion 600 via the communication portion 500, and is combusted at the combustion portion 600 with being unfolded to a ring shape by an additional ignition source. Thus, an object to be heated can be uniformly heated over a wide area.

The liquid fuel introduced into the heating pipe 400 is vaporized in the heating pipe 400, and is re-supplied to the supply portion 122 of the accommodation space 120 communicated with the exhaust opening 110, via another end of the heating pipe 400. Thus, the burner can be used while fuel supply is continuously performed.

In a case where flame generated from the burner is unstably combusted due to excessive fuel supply, the fuel supply should be temporarily stopped. A method of temporarily stopping fuel supply is as follows.

Once the handle 330 protruding to outside of the housing 100 is rotated clockwise, the fuel supply controller 300 moves along the housing 100, and the shielding member 310 of the fuel supply controller 300 blocks the communication hole 121. As a result, fuel supply by the fuel supply member 200 is stopped.

In case of continuously using the burner after fuel supply is temporarily stopped, the handle 330 is rotated counterclockwise. As the shielding member 310 downward moves to be separated from the communication hole 121, the communication hole 121 is open. As a result, fuel supply is resumed to allow the burner to be continuously used.

In a case where initial ignition is not smoothly performed as foreign materials are attached to the exhaustion opening 110 when the burner is used, or soot, etc. occur when fuel is combusted, the handle 330 is rotated clockwise for removal of the foreign materials. As a result, the fuel supply micro-control member 321, provided at an end of the fuel supply controller 300, is inserted into the exhaustion opening 110 to remove the foreign materials. Accordingly, combustion can be stably performed.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A nozzle structure of a burner, comprising:

a housing having an exhaust opening penetratingly-formed at an upper surface thereof, and having therein a single accommodation space communicated with the exhaust opening, wherein the single accommodation space includes: a supply portion disposed at an upper side thereof and communicated with the exhaust opening; an accommodation portion disposed at a lower side thereof; and a communication portion disposed between the supply portion and the accommodation portion, and wherein the communication portion has an inner diameter larger than that of the supply portion, a first tapered boundary region being formed between the supply portion and the communication portion, and the accommodation portion has an inner diameter larger than that of the communication portion, a second tapered boundary region being formed between the communication portion and the accommodation portion;

a fuel supply member connected to the accommodation portion of the single accommodation space for supply of a liquid fuel to inside of the single accommodation space, the fuel supply member being connected to a position lower than the second tapered boundary region;

a fuel supply controller accommodated inside the single accommodation space so as to be movable up and down, and having a fuel supply micro-control member at an end thereof, wherein the fuel supply micro-control member is configured to micro-control an amount of the liquid fuel to be supplied, by being inserted into or separated from the exhaust opening as the fuel supply controller moves up and down; and a heating pipe, one end of which is connected to the communication portion of the single accommodation space, which passes through a combustion portion of the burner, and the other end of which is connected to the supply portion of the single accommodation space, the one end of the heating pipe being connected to a position lower than the first tapered region, such that the liquid fuel supplied into the single accommodation space flows the heating pipe and is vaporized to be supplied into the exhaust opening via the supply portion of the single accommodation space, wherein the fuel supply controller includes:

a shielding member disposed in the accommodation portion, and configured to block a communication hole of the fuel supply member as the fuel supply controller moves up and down; and an extension member extending from an upper surface of the shielding member with a predetermined length, having a diameter smaller than that of the shielding member, and disposed in the communication portion.

2. The nozzle structure of a burner of claim 1, wherein the exhaust opening has a diameter gradually decreased toward an upper side of the exhaust opening.

3. The nozzle structure of a burner of claim 1, wherein a handle is downward extending from a lower surface of the shielding member with a predetermined length, so as to protrude toward outside of the housing.

4. The nozzle structure of a burner of claim 1, wherein a plurality of sealing members of a ring shape are provided on an outer surface of the shielding member with a predetermined distance therebetween, in a height direction of the shielding member.

5. The nozzle structure of a burner of claim 1, wherein a stopper which protrudes with a predetermined diameter is provided at a lower circumferential surface of the shielding member, and wherein a lower cap having a stepped surface is coupled to a lower surface of the housing, the stepped surface configured to restrict movement of the shielding member by contacting one end of the stopper.

* * * * *